US011136174B2

(12) United States Patent
Wu

(10) Patent No.: US 11,136,174 B2
(45) Date of Patent: Oct. 5, 2021

(54) CONTAINER LID ASSEMBLY

(71) Applicant: Hung Kuan Wu, Taipei (TW)

(72) Inventor: Hung Kuan Wu, Taipei (TW)

( * ) Notice: Subject to any disclaimer, the term of this patent is extended or adjusted under 35 U.S.C. 154(b) by 197 days.

(21) Appl. No.: 16/444,181

(22) Filed: Jun. 18, 2019

(65) Prior Publication Data

US 2020/0399034 A1 Dec. 24, 2020

(51) Int. Cl.

| | |
|---|---|
| ***B65D 51/24*** | (2006.01) |
| ***A61J 1/03*** | (2006.01) |
| ***A61J 7/04*** | (2006.01) |
| ***B65D 83/04*** | (2006.01) |
| ***B65D 41/04*** | (2006.01) |
| ***B65D 51/18*** | (2006.01) |
| ***B65D 47/28*** | (2006.01) |
| ***B65D 50/06*** | (2006.01) |

(52) U.S. Cl.

CPC ..... *B65D 51/24* (2013.01); *A61J 1/03* (2013.01); *A61J 7/04* (2013.01); *B65D 41/04* (2013.01); *B65D 47/283* (2013.01); *B65D 50/061* (2013.01); *B65D 51/18* (2013.01); *B65D 83/0481* (2013.01); *B65D 2251/06* (2013.01)

(58) Field of Classification Search

CPC ..... B65D 51/24; B65D 51/18; B65D 51/245; B65D 41/04; B65D 47/283; B65D 50/061; B65D 2251/06; B65D 83/04; B65D 83/0481; A61J 1/03; A61J 7/04

See application file for complete search history.

(56) References Cited

U.S. PATENT DOCUMENTS

| | | | | |
|---|---|---|---|---|
| 5,099,999 | A * | 3/1992 | Balien | B65D 83/0481 206/536 |
| 5,520,307 | A * | 5/1996 | Miller | G07F 11/44 206/459.5 |
| 5,579,933 | A * | 12/1996 | Hofmann | B65D 47/283 206/536 |
| 5,947,345 | A * | 9/1999 | Hofmann | B65D 50/043 222/519 |
| 7,857,134 | B2 * | 12/2010 | Koch | A61J 7/04 206/534 |
| 8,091,719 | B2 * | 1/2012 | Wu | B65D 47/283 215/206 |
| 8,136,687 | B2 * | 3/2012 | Wu | A61J 7/04 220/254.1 |

* cited by examiner

*Primary Examiner* — Don M Anderson

(74) *Attorney, Agent, or Firm* — Rosenberg, Klein & Lee

(57) ABSTRACT

A container lid assembly includes a movable lid, a ratchet ring, a rotary symbol ring, an inner cover, and an annular housing. Once coupled to a container, the container lid assembly can automatically and accurately record the number of times for which it has been opened, thereby reminding the user of whether the contents of the container (e.g., medicine) have been used, lest the user miss a dose of the medicine or retake the medicine unnecessarily. The container lid assembly also allows a plurality of containers to be connected in series to facilitate carrying and management.

1 Claim, 7 Drawing Sheets

A-A

B-B

CONTAINER LID ASSEMBLY

BACKGROUND OF THE INVENTION

1. Technical Field

The present invention relates to structural improvement of a container lid. More particularly, the invention relates to a container lid assembly for use with a container that contains pills or other granular objects, wherein the container lid assembly can accurately record the number of times for which it has been opened.

2. Description of Related Art

A medicine container, such as a pill container, generally has so large an opening that it is difficult to tip out the desired number of pills in one go without pouring out of a load of pills or dropping the pills all over the place. This can be a serious issue to patients who tend to forget whether they have taken their medicine, for they may take a certain dose repeatedly or skip a dose or two without knowing it.

In view of the above, the inventor of the present invention developed a lid structure for overcoming the aforesaid drawback and was granted therefor Taiwan Utility Model Patent No. M359519 ("Structural improvement of container lid") and Taiwan Utility Model Patent No. M377396 ("Further improvement of container lid"). Patent applications for the same utility models were also filed in the US and were allowed as U.S. Pat. No. 8,091,719 ("Container cap") and U.S. Pat. No. 8,136,687 ("Cover of container").

During the actual manufacturing processes of the two patented structures, however, the inventor found it difficult to mass-produce the necessary molds, and this eventually led to low production efficiency and high production cost.

Moreover, referring to FIG. 1, the primary objective and effect of the cover disclosed in U.S. Pat. No. 8,136,687 are for the cover (the movable lid 110) to record and display the number of times for which it has been opened, thereby reminding the user of whether he or she has taken the medicine in the container. However, as the medicine in the container 550 can be tipped out directly through the opening 1020*d* formed by lifting the movable lid 110, the user is very likely to forget that the lifted movable lid 110 must also be rotated in order to rotate the symbol ring 660 to the next position and thereby update the number of times of use.

The inventor soon realized that it is the operating procedure required by the cover structure that tends to result in a user's incomplete medicine withdrawing operation and hence inaccurate recording of the number of times of use.

In addition, a patient with a chronic disease may have to take more than one medicine and therefore may use multiple containers to store the medicines separately and to facilitate management of the medicines. Nevertheless, the multiplicity of the containers invites confusion and consequently difficulty in finding a certain container. When the containers are placed in a backpack, the backpacker's movement may displace the containers in different directions, making it even more time-consuming to find the desired container.

Urged by the need to better the existing structures, the inventor sought to make further improvement and finally succeeded in developing the superior structure disclosed herein.

The structural details, objectives, implementation method, and spirit of the present invention can be better understood by referring to the following detailed description in conjunction with the accompanying drawings.

BRIEF SUMMARY OF THE INVENTION

The present invention relates to a structurally improved container lid that not only can accurately display the number of times for which the lid has been opened, but also allows a plurality of containers to be connected in series to facilitate management and carrying.

The primary objective of the present invention is to provide a container lid assembly and an operating procedure thereof that enable automatic update and display of the number of times of use as soon as the container lid assembly is opened, thereby reminding the user, e.g., a patient, of whether he or she has taken the medicine in a container, ensuring that the patient will not take the same dose again by accident but know exactly whether a dose is due. Furthermore, the container lid assembly of the invention makes it possible to connect a plurality of containers in series to facilitate management. Last but not least, it has been demonstrated that the structural design disclosed herein can be mass-produced and contribute to cost reduction.

DETAILED DESCRIPTION OF THE INVENTION

Figure 1:
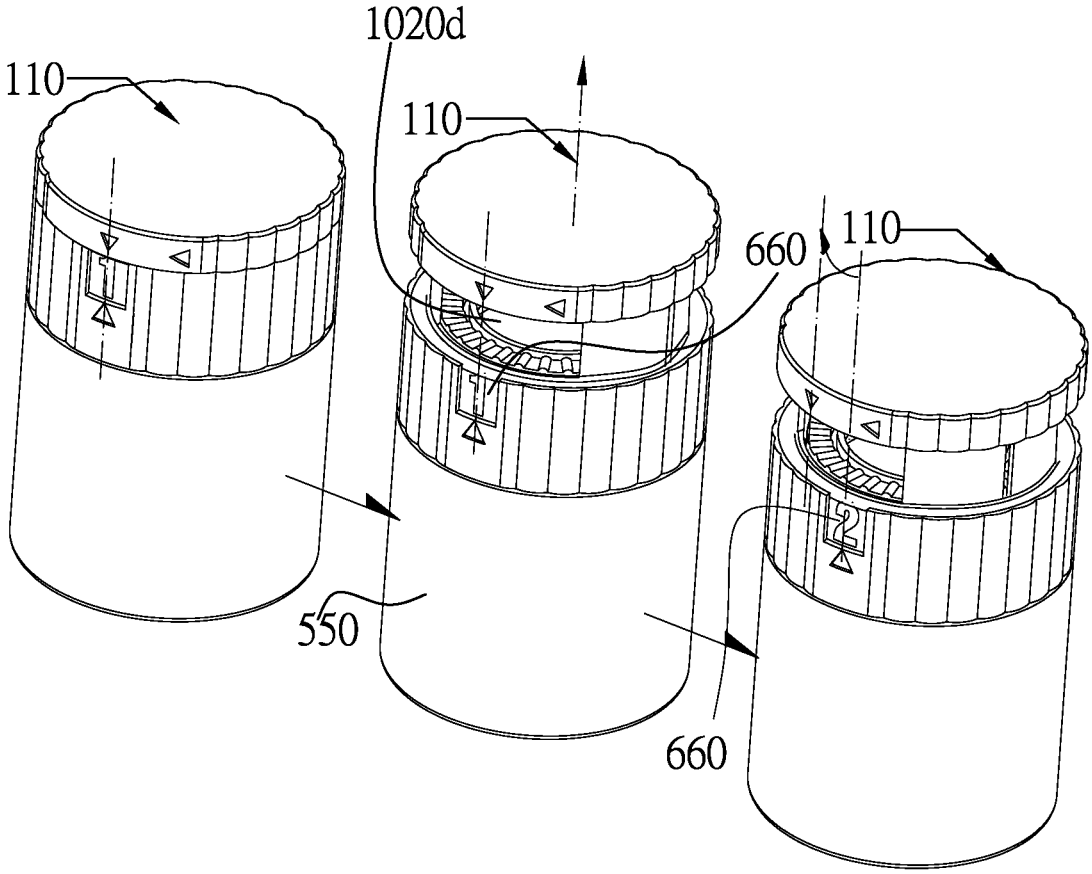
Prior Art FIG.1
FIG. 1 shows three states of use of a conventional cover of a container as disclosed in U.S. Pat. No. 8,136,687.
Figure 2:
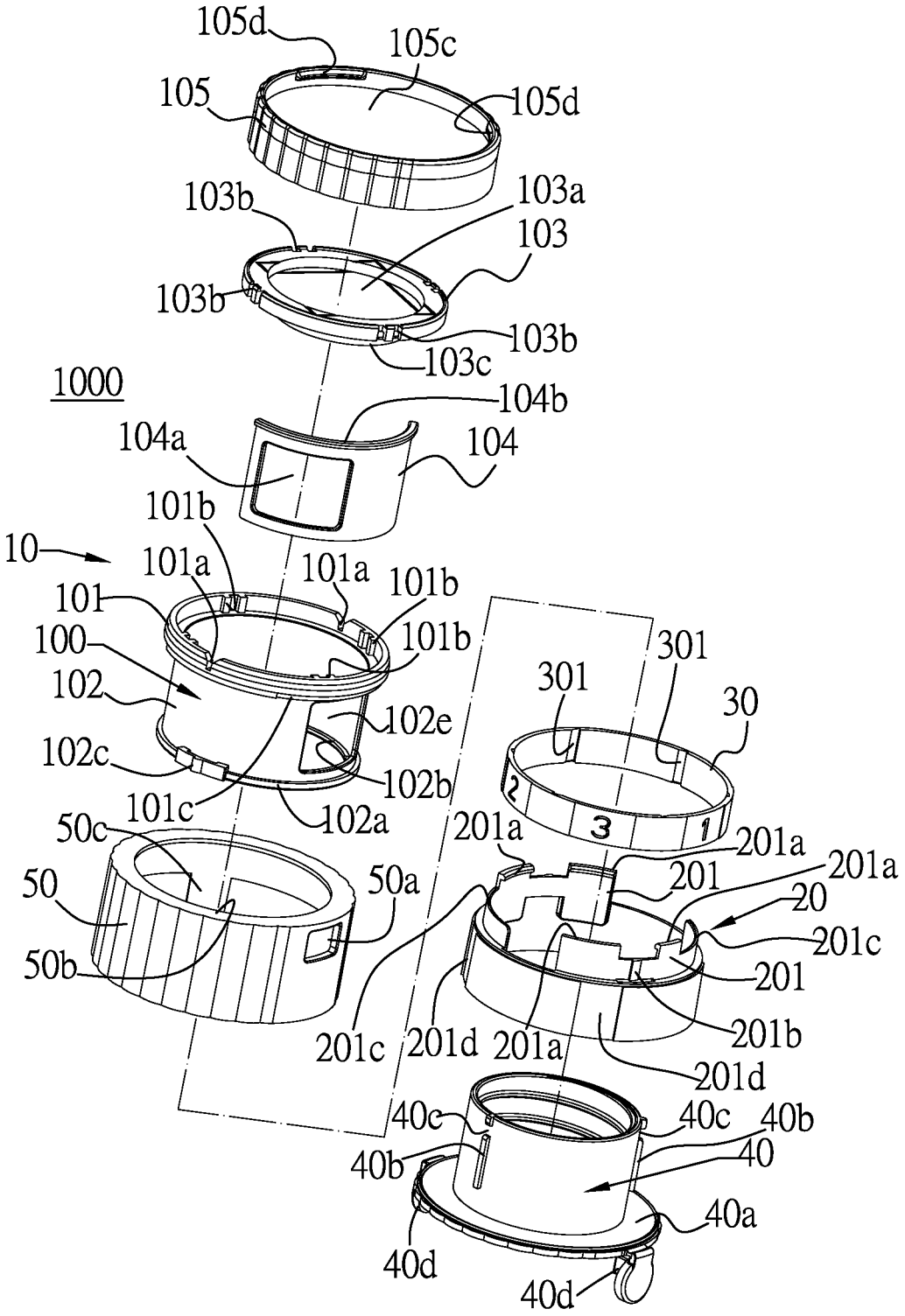
FIG. 2 is an exploded perspective view of a container lid assembly according to the present invention.

Referring to FIG. 2 for an exploded perspective view of a container lid assembly 1000 according to the present invention, the container lid assembly 1000 includes a movable lid 10, a ratchet ring 20, a rotary symbol ring 30, an inner cover 40, and an annular housing 50.

Figure 4:
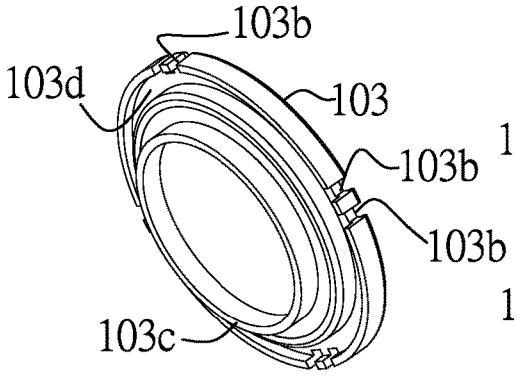
FIG. 4 is a perspective view of the circular cover in FIG. 2.
Figure 3:
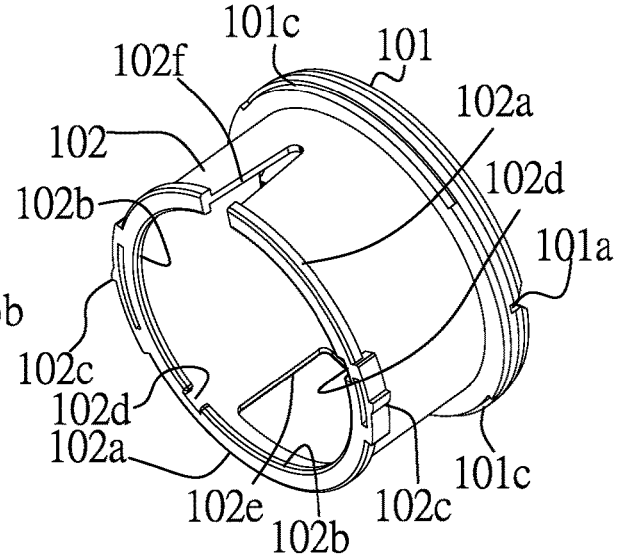
FIG. 3 is a perspective view of the vertically movable member in FIG. 2.
Figure 9:
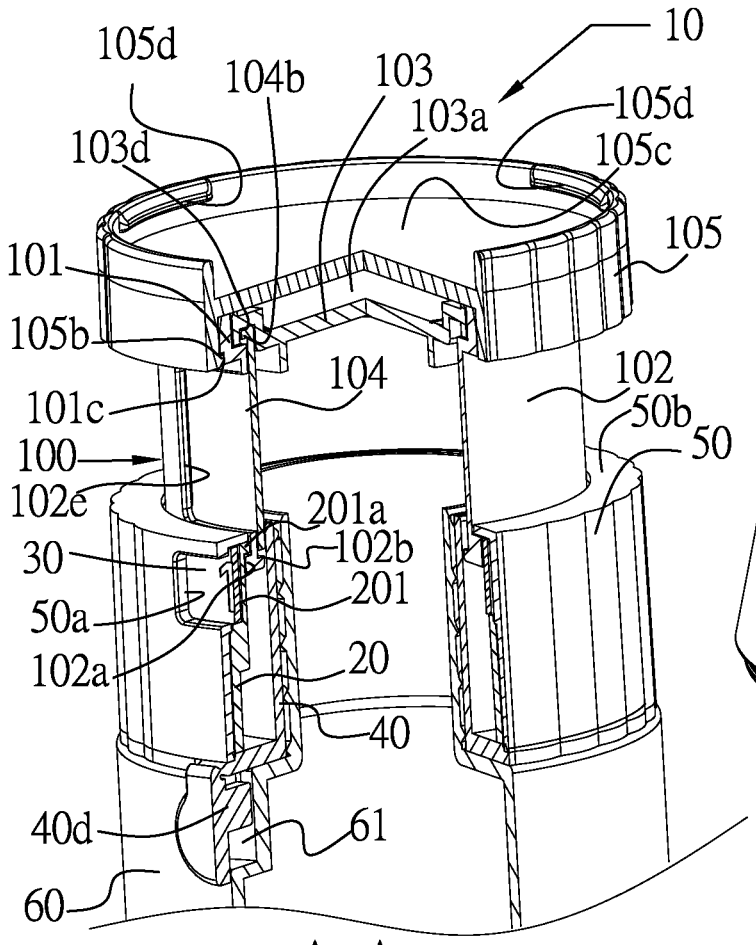
FIG. 9 is a perspective sectional view taken along line A-A in FIG. 13.
Figure 10:
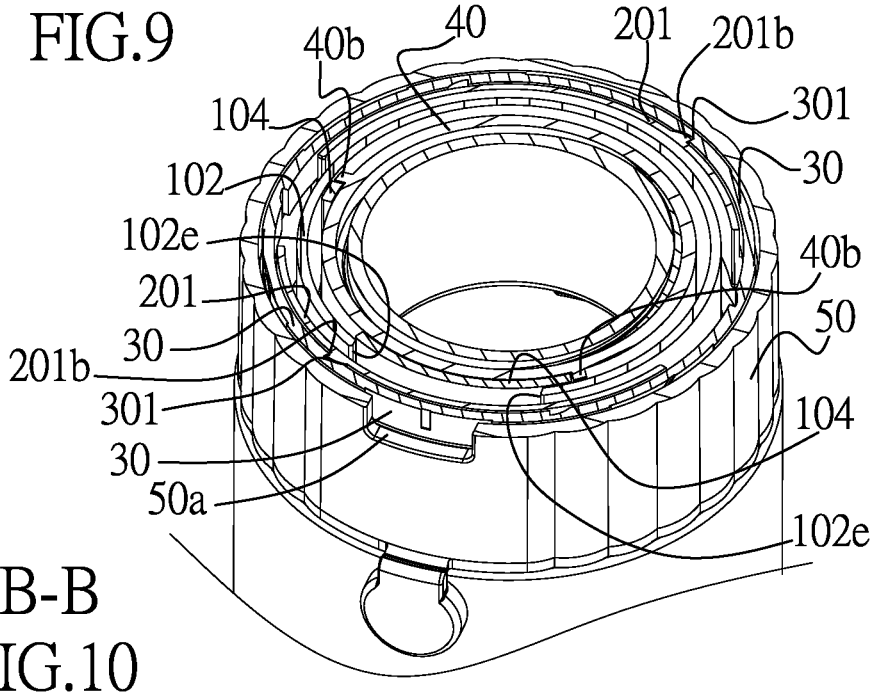
FIG. 10 is a perspective sectional view taken along line B-B in FIG. 13.

As shown in FIG. 2 and FIG. 3, the movable lid 10 includes a vertically movable member 100 configured as an insertion tube 102. An opening 102*e* is formed at the front side of the insertion tube 102. A protruding annular wall 101 extends upward from the outer periphery of the upper end of the insertion tube 102 and is formed with two notches 101*a* in a top portion. The inner side of the protruding annular wall 101 is provided with plural pairs of alternately arranged projections 101*b*. The bottom side of the protruding annular wall 101 is provided with a fastening groove 101*c*. An outer flange 102*a* and an inner flange 102*b* are provided on a bottom portion of the insertion tube 102. The outer flange 102*a* is provided with two corresponding protuberances 102*c*. The inner flange 102*b* is provided with two spaced-apart recesses 102*d*. A bottom portion of the insertion tube 102 is formed with a slit 102*f* extending upward from the outer flange 102*a* and the inner flange 102*b*. The slit 102*f* allows a lower portion of the insertion tube 102 to be temporarily constricted (i.e., temporarily reduced in diameter) during assembly. A circular cover 103 has a hollow portion 103*a* at the top side, and a chip is fixed in the hollow portion 103*a*. The bottom side of the circular cover 103 is provided with an annular concave track 103*d* and a protruding insertion tube 103*c* (see FIG. 4). The outer periphery of the circular cover 103 is provided with plural pairs of alternately arranged engaging grooves 103*b*. The circular cover 103 is fixedly positioned on the vertically movable member 100 through engagement between the engaging grooves 103*b* of the circular cover 103 and the plural pairs of alternately arranged projections 101*b* on the inner side of the protruding annular wall 101 of the insertion tube 102. An arcuate plate 104 has an opening 104*a* on a lateral side and is provided with a flange 104*b* along the top side. Referring to FIG. 9 and FIG. 10, the arcuate plate 104 is located behind the opening 102*e* of the insertion tube 102 (i.e., the vertically movable member 100) to close the opening 102*e*, with a bottom portion of the arcuate plate 104 sitting on the inner flange 102*b* on the bottom portion of the insertion tube 102, and with the flange 104*b* of the arcuate plate 104 extending into the annular concave track 103*d* at the bottom side of the circular cover 103. A top cover 105 (see FIG. 2, FIG. 3, FIG. 5, and FIG. 9) is configured as a tubular cover, with a partition plate 105*c* provided therein and two blocks 105*a* provided on a bottom portion of the partition plate 105*c*. The blocks 105*a* correspond to and are positioned in the notches 101*a* in the protruding annular wall 101 of the insertion tube 102 respectively. The bottom inner periphery of the top cover 105 is provided with a protruding fastening flange 105*b* to be fastened to the fastening groove 101*c* in the bottom side of the protruding annular wall 101 of the insertion tube 102. The top inner periphery of the top cover 105 is provided with a plurality of protruding gripping flanges 105*d*.

The chip provided in the hollow portion 103*a* of the circular cover 103 can be used to record or read a patient's data and medicine-related data.

As shown in FIG. 2, the ratchet ring 20 has an annular body whose inner periphery is provided with two upwardly extending and corresponding ratchet tooth features 201. Each ratchet tooth feature 201 includes a gripping portion 201*a*, an angled tooth 201*b*, and a supporting plate 201*c* extending from a lateral side of the gripping portion 201*a*. The annular outer periphery of the ratchet ring 20 is provided with a plurality of recessed portions 201*d*. Referring to FIG. 9 and FIG. 10, the two ratchet tooth features 201 are inserted into the rotary symbol ring 30, in order for the angled teeth 201*b* of the two ratchet tooth features 201 to engage with the corresponding sideways recesses 301 in the inner periphery of the rotary symbol ring 30 respectively, allowing the rotary symbol ring 30 to be rotated in one direction only.

Figure 12:
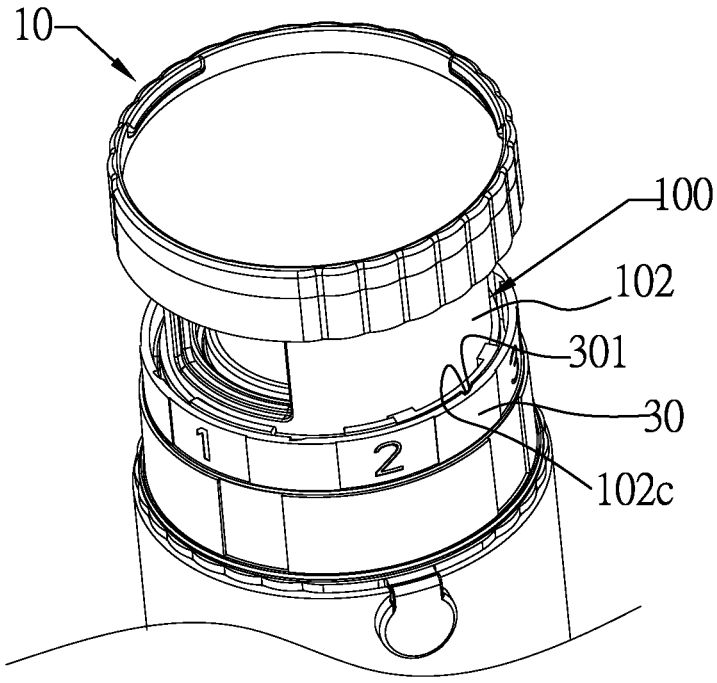
FIG. 12 is a perspective view in which the protuberances of the vertically movable member are respectively engaged in the corresponding sideways recesses of the rotary symbol ring.

The movable lid 10 is inserted into, and vertically movable in, the ratchet ring 20. When the movable lid 10 is pulled upward to a predetermined position as shown in FIG. 9, the gripping portions 201*a* of the two ratchet tooth features 201 are hooked to the outer flange 102*a* of the insertion tube 102 (i.e., the vertically movable member 100) of the movable lid 10 to prevent detachment of the movable lid 10. In addition, referring to FIG. 12, the two protuberances 102*c* of the vertically movable member 100 of the movable lid 10 are engaged with the corresponding sideways recesses 301 of the rotary symbol ring 30 respectively.

The rotary symbol ring 30 has an annular body and is provided with a plurality of symbols on the outer periphery and the sideways recesses 301 in the inner periphery.

Figure 6:
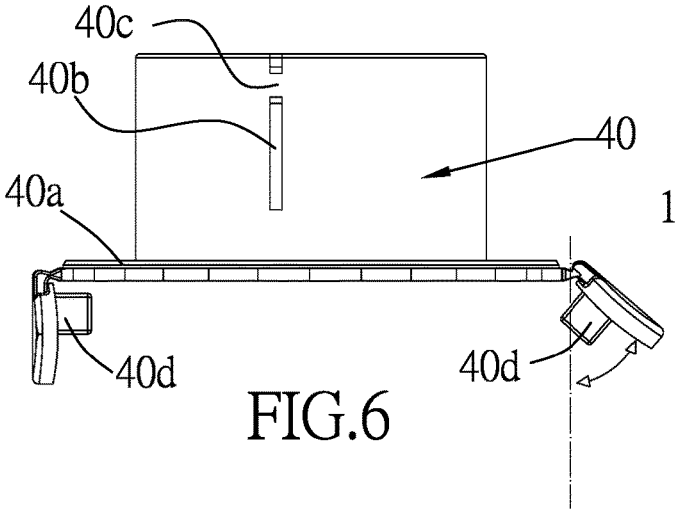
FIG. 6 shows the pin movement of the inner cover in FIG. 2.
Figure 5:
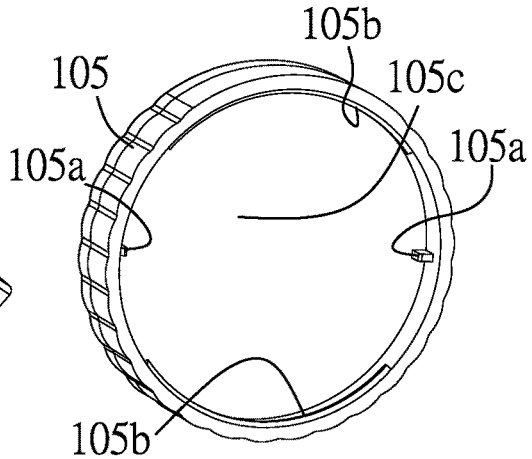
FIG. 5 is a perspective view of the top cover in FIG. 2.

Referring to FIG. 2 in conjunction with FIG. 6, the inner cover 40 has a tubular body with a threaded inner periphery and is provided with an annular bottom plate 40*a* at a bottom portion. The outer periphery of the tubular body of the inner cover 40 is provided with two spaced-apart ribs 40*b*, with an opening 40*c* in an upper portion of each rib 40*b* so that the inner flange 102*b* on the bottom portion of the insertion tube 102 (see FIG. 3) can move in the openings 40*c*. The inner flange 102*b* on the bottom portion of the insertion tube 102 can also move in the gap between a bottom portion of each rib 40*b* and the annular bottom plate 40*a*. The outer periphery of the annular bottom plate 40*a* is provided with two pins 40*d* that can be lifted and lowered in a pivotal manner.

Referring also to FIG. 3, FIG. 9, and FIG. 10, the inner cover 40 is coupled in the insertion tube 102 (i.e., the vertically movable member 100) of the movable lid 10 in such a way that the two ribs 40*b* on the inner cover 40 correspond to and are vertically movable in the two recesses 102*d* in the inner flange 102*b* on the bottom portion of the insertion tube 102 respectively, and that the arcuate plate 104, which is inside the vertically movable member 100 of the movable lid 10, lies between and is confined by the two ribs 40*b* of the inner cover 40 and therefore can only be moved up and down in a reciprocating manner between the ribs 40*b*.

Figure 7:
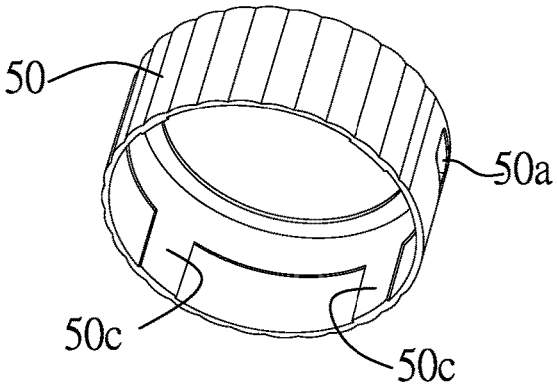
FIG. 7 is a perspective view of the annular housing in FIG. 2.
Figure 8:
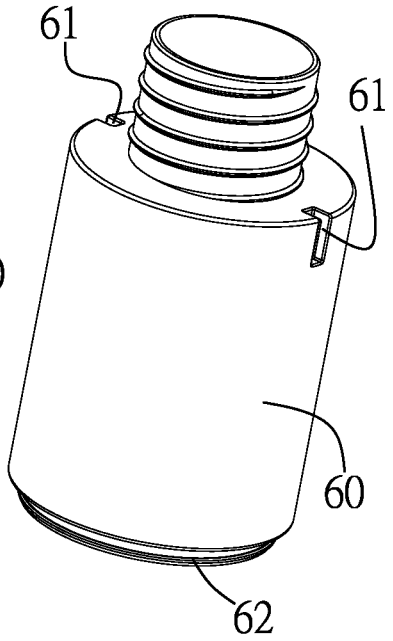
FIG. 8 is a perspective view of a container for use with the container lid assembly in FIG. 2.

Referring to FIG. 2 in conjunction with FIG. 7, FIG. 9, and FIG. 10, the annular housing 50 has an annular body formed with an opening 50*a*. A top portion of the annular housing 50 is protrudingly provided with a top edge 50*b* while the inner periphery of the annular housing 50 is provided with a plurality of protruding plates 50*c* corresponding respectively to the recessed portions 201*d* of the outer periphery of the ratchet ring 20. The ratchet ring 20 coupled with the rotary symbol ring 30 is inserted into the annular housing 50, with the protruding plates 50*c* on the inner periphery of the annular housing 50 inserted respectively into the recessed portions 201*d* of the outer periphery of the ratchet ring 20, and with the top edge 50*b* of the annular housing 50 lying above the ratchet tooth features 201 of the ratchet ring 20 and the rotary symbol ring 30 coupled thereto to prevent detachment of the ratchet ring 20 and the rotary symbol ring 30. The opening 50*a* of the annular housing 50 corresponds to the rotary symbol ring 30 so that any symbol aligned with the opening 50*a* is visible through the opening 50*a*. The container lid assembly 1000 is completed when the bottom edge of the annular housing 50 is fixedly coupled to the annular bottom plate 40*a* of the inner cover 40. As shown in FIG. 6, FIG. 8, and FIG. 9, the container lid assembly 1000 can be threadedly connected to a container 60 with two fastening holes 61 that are configured to match the two pins 40*d* on the inner cover 40 respectively, and by pressing the two pins 40*d* of the inner cover 40 into the fastening holes 61 of the container 60 respectively, the container lid assembly 1000 is kept from getting loose.

Figure 15:
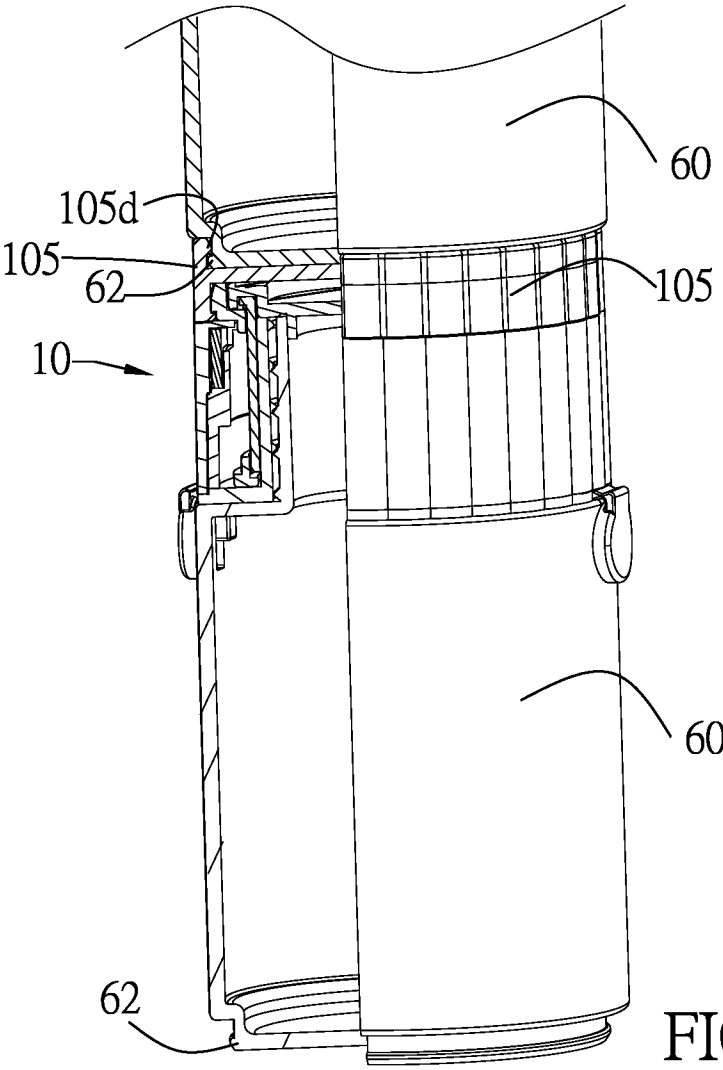
FIG. 15 shows how two containers as shown in FIG. 8 are connected in series by the container lid assembly in FIG. 2.

Referring to FIG. 8 and FIG. 15, the two fastening holes 61 are provided in an upper portion of the container 60 while a connecting ledge 62 is provided on a bottom portion of the container 60. The connecting ledge 62 can be fastened to the protruding gripping flanges 105*d* on the top inner periphery of the top cover 105, thereby enabling a plurality of containers 60 to be connected in series.

Figure 11:
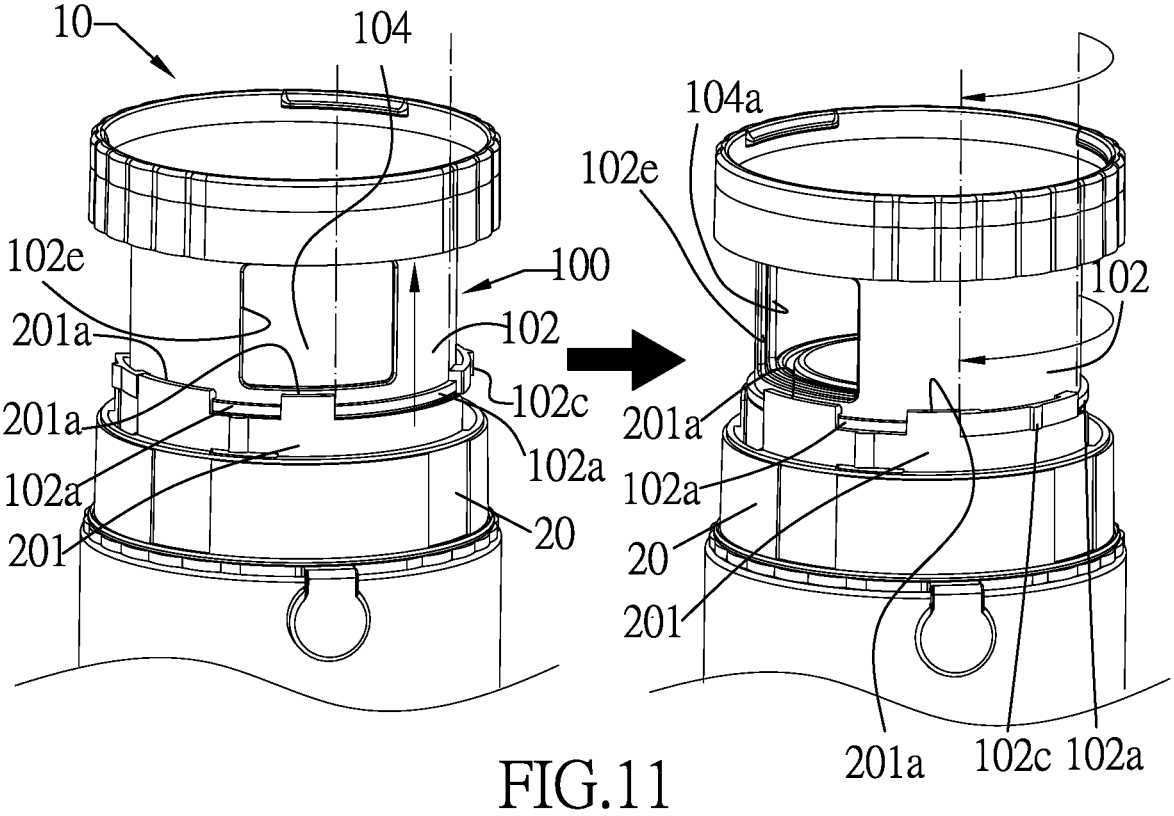
FIG. 11 shows how the movable lid in FIG. 2 is rotated to a predetermined position.
Figure 13:
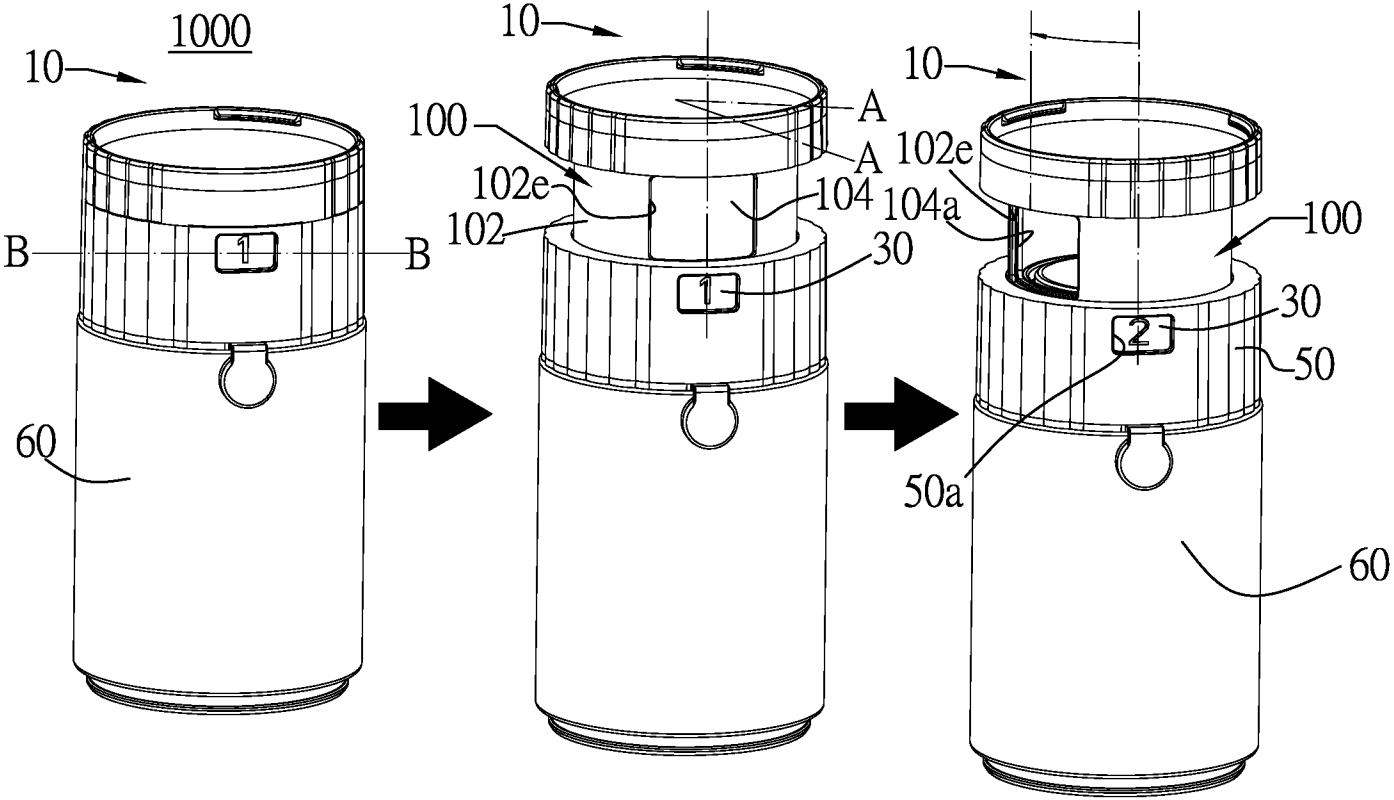
FIG. 13 shows three states of use of the container lid assembly in FIG. 2.
Figure 14:
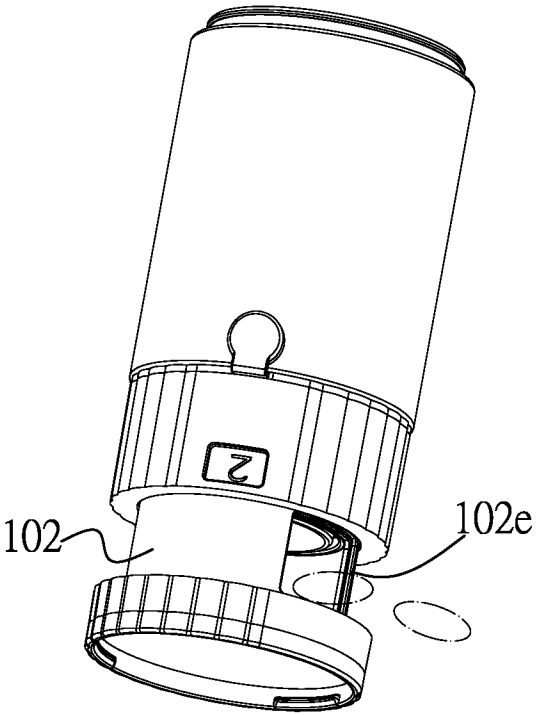
FIG. 14 is a perspective view showing how pills are tipped out more desirably than in the prior art through the container lid assembly in FIG. 2.

FIG. 13 shows how the container lid assembly 1000 is used. The container 60 in FIG. 13 is threadedly connected to and sealed by the container lid assembly 1000. When it is desired to take pills out of the container 60, the movable lid 10 is pulled upward to a predetermined position such that, referring to FIG. 9, FIG. 10, and FIG. 11, the gripping portions 201*a* of the ratchet tooth features 201 of the ratchet ring 20 are hooked to the outer flange 102*a* of the insertion tube 102 (i.e., the vertically movable member 100) of the movable lid 10 to prevent the movable lid 100 from detachment. In this state, the opening 102*e* of the insertion tube 102 is closed by the arcuate plate 104 standing behind it, and the protuberances 102*c* on the vertically movable member 100 of the movable lid 10 are engaged with the corresponding sideways recesses 301 of the rotary symbol ring 30 respectively (see FIG. 11 and FIG. 12). Then, the movable lid 10 is rotated, with the bottom portions of the protuberances 102*c* on the vertically movable member 100 of the movable lid 10 staying respectively on the supporting plates 201*c* of the ratchet ring 20 to prevent the movable lid 10 from descending. When the movable lid 10 in rotation reaches a predetermined position, the protuberances 102*c* are in abutment against sidewalls of the gripping portions 201*a* of the ratchet tooth features 201 respectively, the opening 102*e* of the insertion tube 102 is in alignment with the opening 104*a* of the arcuate plate 104, forming a hole in communication with the interior space of the container 60, and the rotary symbol ring 30 has been rotated from the previous position to the current position (e.g., from the position where the symbol "1" is visible through the opening 50*a* of the annular housing 50 to the position where the next symbol "2" can be seen) to indicate the number of times of use. The pills in the container 60 can now be poured out through the opening 102*e* at the front side of the insertion tube 102, as shown in FIG. 14.

To close the container lid assembly 1000 after the desired number of pills are obtained, the foregoing steps are performed in reverse order and in the opposite direction. During the reverse operation, referring to FIG. 10, the angled teeth 201*b* of the ratchet tooth features 201 are pressed respectively against walls of the corresponding sideways recesses 301 of the rotary symbol ring 30 to keep the rotary symbol ring 30 from reverse rotation; in other words, the rotary symbol ring 30 can only be rotated in one direction and will not be rotated by the reverse operation. Consequently, the symbol displayed through the opening 50*a* of the annular housing 50 remains unchanged, serving as a reminder of the number of times of use.

What is claimed is:

1. A container lid assembly, comprising:

a movable lid including a vertically movable member, a circular cover, an arcuate plate, and a top cover, wherein the vertically movable member has an insertion tube, the insertion tube has a front side formed with an insertion tube opening, a protruding annular wall extends in an upward direction from an outer periphery of an upper end of the insertion tube, the protruding annular wall has a top portion formed with two spaced-apart notches, the protruding annular wall has an inner side provided with a plurality of pairs of alternately arranged projections, the protruding annular wall has a bottom side provided with a fastening groove, the insertion tube has a bottom portion provided with an outer flange and an inner flange, the outer flange is provided with two spaced-apart protuberances, the inner flange is provided with two spaced-apart recesses, the bottom portion of the insertion tube is formed with a slit extending upward from the outer flange and the inner flange to permit a lower portion of the insertion tube to be temporarily reducible in diameter during assembly, the circular cover has a top side provided with a hollow portion, a chip is fixable in the hollow portion, the circular cover has a bottom side provided with an annular concave track and a protruding insertion tube, an outer periphery of the circular cover is formed with a plurality of pairs of alternately arranged engaging grooves, the circular cover is fixedly positioned with respect to the vertically movable member through engagement between the plurality of pairs of alternately arranged engaging grooves of the circular cover and corresponding plurality of pairs of alternately arranged projections on the inner side of the protruding annular wall of the insertion tube, the arcuate plate has a lateral side formed with an arcuate plate opening and has a top side provided with a flange, the arcuate plate is located behind the insertion tube opening of the insertion tube to thereby selectively close the insertion tube opening of the insertion tube, the arcuate plate has a bottom portion disposed on the inner flange on the bottom portion of the insertion tube, the flange of the arcuate plate extends into and is disposed in the annular concave track at the bottom side of the circular cover, the top cover is a tubular cover and is provided therein with a partition plate, the partition plate has a bottom portion provided with two spaced-apart blocks, the two spaced-apart blocks correspond to and are positioned in the two spaced-apart notches formed in the protruding annular wall of the insertion tube, respectively, the top cover has a bottom inner periphery provided with a protruding fastening flange, the protruding fastening flange is fastened to the fastening groove formed in the bottom side of the protruding annular wall of the insertion tube, and the top cover has a top inner periphery provided with a plurality of protruding gripping flanges;

a ratchet ring having an annularly contoured body, wherein the ratchet ring has an inner periphery provided with two upwardly extending and corresponding ratchet tooth features, each said ratchet tooth feature includes two gripping portions, an angled tooth, and a supporting plate extending from a lateral side of a corresponding gripping portion, the ratchet ring has an annular outer periphery provided with a plurality of recessed portions, the two ratchet tooth features are insertable into a rotary symbol ring, the rotary symbol ring is an annularly contoured body and is formed with a plurality of sideways recesses in an inner periphery thereof, each angled tooth of the two ratchet tooth features engages with a corresponding sideways recess of the plurality of sideways recesses of the rotary symbol ring, respectively, the rotary symbol ring is thereby rotatable in only one direction, the movable lid is insertable into, and vertically movable in the ratchet ring, and when the movable lid is lifted to a predetermined position, the gripping portions of the two ratchet tooth features are hooked onto the outer flange of the insertion tube of the movable lid thereby preventing detachment of the movable lid, and each of the two spaced-apart protuberances of the vertically movable member of the movable lid is engaged with a corresponding sideways recess of the plurality of sideways recesses of the rotary symbol ring, respectively;

wherein an outer periphery of the rotary symbol ring is provided with a plurality of symbols;

an inner cover formed as a tubular body and having a threaded inner periphery, a bottom portion of the inner cover is provided with an annular bottom plate, and an outer periphery of the inner cover is provided with two spaced-apart ribs, wherein each of said two spaced-apart ribs has an upper portion provided with an opening, the inner flange formed on the bottom portion of the insertion tube is movable in each opening of the two spaced-apart ribs, the inner flange formed on the bottom portion of the insertion tube is also movable in a gap formed between a bottom portion of each rib of the two said spaced-apart ribs and the annular bottom plate, the annular bottom plate has an outer periphery provided with two spaced-apart movable pins, and the inner cover is coupled to the insertion tube of the movable lid whereby the two ribs formed on the inner cover correspond to and are vertically movable in the two recesses formed in the inner flange on the bottom portion of the insertion tube, respectively, the arcuate plate of the movable lid thereby lies between and is confined by the two spaced-apart ribs of the inner cover to be only displaceable between the two spaced-apart ribs; and an annular housing having an annularly-contoured body formed with an annular housing opening, wherein the annular housing has a top portion provided with a top protruding edge, the annular housing has an inner periphery provided with a plurality of protruding plates corresponding in position, respectively, to the plurality of recessed portions formed on the outer periphery of the ratchet ring, the ratchet ring and the rotary symbol ring are thereby coupled to one another for insertion together into the annular housing, the plurality of protruding plates formed on the inner periphery of the annular housing are inserted into the plurality of recessed portions formed on the outer periphery of the ratchet ring, respectively, and the top protruding edge of the annular housing is located above the two ratchet tooth features of the ratchet ring and the rotary symbol ring to prevent detachment of the ratchet ring and the rotary symbol ring, the annular housing opening of the annular housing corresponds in position to the rotary symbol ring for displaying a selective symbol of said plurality of symbols aligned with the annular housing opening of the annular housing, and a bottom edge of the annular housing is fixedly coupled to the annular bottom plate of the inner cover for fully assembling the movable lid, the ratchet ring, the rotary symbol ring, the inner cover, and the annular housing to one another, the fully-assembled movable lid, ratchet ring, rotary symbol ring, inner cover, and annular housing is threadedly connectable to a container having two spaced-apart fastening holes matching in position to the two movable pins formed on the inner cover, respectively, the fully-assembled movable lid, ratchet ring, rotary symbol ring, inner cover, and annular housing is thereby prevented from being displaceable relative to the container subsequent to the two movable pins formed on the inner cover being pressed into the two fastening holes of the container, respectively, the two fastening holes are provided in an upper portion of the container, the container has a bottom portion provided with a connecting ledge, and the connecting ledge is fastenable to the plurality of protruding gripping flanges formed on the top inner periphery of the top cover for providing a plurality of said containers to be connected in series;

wherein when the fully-assembled movable lid, ratchet ring, rotary symbol ring, inner cover, and annular housing is connected to the container and the movable lid is lifted to the predetermined position, the gripping portions of the ratchet tooth features of the ratchet ring are hooked onto the outer flange of the insertion tube of the movable lid to prevent detachment of the movable lid, the insertion tube opening of the insertion tube is blocked by the arcuate plate disposed behind the insertion tube opening of the insertion tube, and the two spaced-apart protuberances formed on the vertically movable member of the movable lid are engaged with corresponding sideways recesses of the plurality of sideways recesses formed on the rotary symbol ring, respectively; when the movable lid is subsequently rotated, bottom portions of the two spaced-apart protuberances formed on the vertically movable member of the movable lid are engaged with the supporting plates of the two ratchet tooth features of the ratchet ring, respectively, to thereby prevent the movable lid from descending; and when the rotated movable lid reaches a further predetermined position, the two spaced-apart protuberances abut against corresponding sidewalls of the gripping portions of the two ratchet tooth features, respectively, the insertion tube opening of the insertion tube is thereby aligned with the arcuate plate opening of the arcuate plate for forming a communication path with an interior space of the container to thereby permit contents within the container to be dispensed through the insertion tube opening at the front side of the insertion tube, and the rotary symbol ring being rotated from an initial position to a subsequent position, wherein in the initial position of the rotary symbol ring, a previous symbol of the plurality of symbols is displayed through the annular housing opening of the annular housing, wherein in the subsequent position of the rotary symbol ring, a symbol of the plurality of symbols following the previous symbol is displayed through the annular housing opening of the annular housing to indicate a number of times of use.

* * * * *